United States Patent [19]

Glovak et al.

[11] 4,212,462

[45] Jul. 15, 1980

[54] HYDROPLANING DISC

[76] Inventors: Danny W. Glovak, 2651 Holmes, Hamtramck, Mich. 48212; Allan W. Buyze, 2701 South Fairview #N-16, Santa Ana, Calif. 92704

[21] Appl. No.: 912,285

[22] Filed: Jun. 5, 1978

Related U.S. Application Data

[63] Continuation-in-part of Ser. No. 739,837, Nov. 8, 1976, Pat. No. 4,151,997.

[51] Int. Cl.[2] ..... A63B 65/10; A63B 67/06

[52] U.S. Cl. ..... 273/424

[58] Field of Search ..... 46/74 D; 273/106 B, 273/105.4, 106 R, 106 F, 33; 102/92.1; D21/7, 86, 203

[56] References Cited

U.S. PATENT DOCUMENTS

| | | | |
|---|---|---|---|
| 12,801 | 5/1855 | Von Kammerhueber | 273/106 B |
| 1,815,520 | 7/1931 | McLeod | 273/33 |
| 2,798,722 | 7/1957 | Fluhrer | 273/106 B |
| 3,376,040 | 4/1968 | Moehlman et al. | 273/105.4 |
| 3,544,113 | 12/1970 | Hand | 273/106 B |
| 3,613,295 | 10/1971 | Everett | 46/74 D |
| 3,840,232 | 10/1974 | Ludwig et al. | 273/105.4 |
| 3,895,801 | 7/1975 | Baird | 273/106 B X |
| 3,930,650 | 1/1976 | Watson | 273/106 B |

FOREIGN PATENT DOCUMENTS

| | | | |
|---|---|---|---|
| 181801 | 4/1955 | Austria | 273/106 B |
| 438000 | 4/1927 | Fed. Rep. of Germany | 273/106 B |
| 4346 | of 1913 | United Kingdom | 273/33 |

*Primary Examiner*—F. Barry Shay

*Attorney, Agent, or Firm*—Barnes, Kisselle, Raisch & Choate

[57] ABSTRACT

An aerodynamic and hydromechanical hydroplaning disc with a solid unitary body comprised of aggregated material. The disc is heavier than the water it displaces and non-floating. The peripheral edge of the disc is formed with a top to bottom curvature having a relatively smaller radius at the top than at the bottom of the disc which reduces air resistance and has a shape to increase the planing capacities as the disc strikes the water. The texture of the material is also significant in combination with circular or polygonal edge formations to enhance the aerodynamic, hydrodynamic and hydromechanical characteristics.

9 Claims, 10 Drawing Figures

HYDROPLANING DISC

Figure 1:
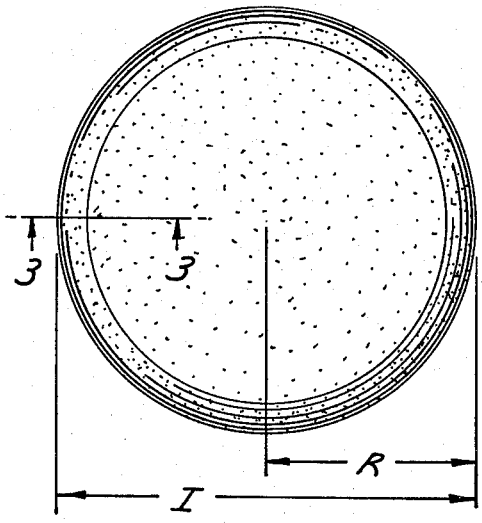

This application is a continuation-in-part of our copending application, Ser. No. 739,837, filed Nov. 8, 1976, and entitled "Hydroplaning Disc," now issued into U.S. Pat. No. 4,151,997, dated May 1, 1979.

The spirit and scope of this concept relates to implements having both aerodynamic and hydromechanical properties and, in particular, to an aerodynamic hydroplaning disc with a solid unitary body to be thrown through the air and to hydroplane over a body of water for use in hydroplaning disc games.

Webster's Unabridged International Dictionary defines a drake or drakestone as a skipping stone; a flat stone used in the game of ducks and drakes (i.e., in stone skipping games). The present invention is an extrapolation and improvement of the naturally occurring "skipping stone." With this new disc, a very desirable quality is available to the individual thrower and to throwers in competition, namely, consistency. The infinite variability inherent in naturally occurring stones and the resulting infinite variability in aeroplaning and hydroplaning is eliminated. Thus, individual improvement can be measured and competition becomes meaningful in the game of ducks and drakes.

The configuration of the disc constructed in accordance with the present invention is primarily to be used for a sport, namely, skipping of stones, and each disc is intended to be used only once and in use is thrown away.

Since water ecology is a basic concern with the use of this invention, each disc is composed of ecologically complimentary materials, for example, sand plus a water soluble organic binder. Because the natural materials used are common to the surrounding environment, upon decomposition, the used disc would easily and naturally blend with its compatible environment. Conceivably, with the addition of selected chemicals, this hydroplaning disc would become an inviting and enjoyable means of achieving ecological improvement in local aquatic areas.

The entire surface of the disc has a uniform granular texture. This feature assures a positive grip even when the hand of the thrower is wet. Also, hydroplaning stability (i.e., the ability of the disc to correct itself to a horizontal orientation while hydroplaning) is significantly increased specifically due to said granular texture on the substantially flat bottom surface and the extreme periphery. Said texture can increase in coarseness in direct proportion to the increase in the degree of circularity of the disc and said texture improves the hyroplaning stability and the effective range of each disc configuration, especially the more circular configurations.

The elevational view of this invention reveals a shape that simultaneously combines an airfoil and a hydrofoil. This configuration provides beneficial aerodynamic advantages during the flight of the disc from its initial release to its first contact with the water. Similarly, hydroplaning advantages occur each time the disc skips from the surface of the water to become totally or partially airborne.

The sides of the regular polygon-shaped disc are connected by transitional surfaces which are the tangential arcs joining adjacent sides. Each straight side of the disc has two ends which join tangentially to the adjacent transitional surfaces forming what shall hereafter be referred to as a peripheral hydrofil. Each peripheral hydrofoil includes one-half of the two adjacent transitional sufaces. The six-sided regular polygon-shaped disc has six peripheral hydrofoils; the twelve-sided regular polygon-shaped disc has twelve peripheral hydrofoils, etc. The circularity of said disc increases in direct proportion to the increase of the number of peripheral hydrofoils. Optimum performance is achieved with no fewer than six peripheral hydrofoils and the radius of said transitional surfaces is equal to approximately one-third of the maximum diameter of the disc. Also, the length of the transitional radius may increase inversely to the number of peripheral hydrofoils (i.e., the fewer the peripheral hydrofoils, the greater the transitional radius). Said transitional radii have a functional range of adjustment wherein the dimension of said radii would be less than or equal to one-half the maximum diameter of said disc but greater than or equal to one-eighth the maximum diameter of said disc. When the length of the transitional radius is equal to the radius of said disc, a circular disc is formed.

The peripheral hydrofoils produce an interferring effect on the airflow and waterflow around the circumference of the disc and, depending on whether the disc is in the air or partially submerged, create a continuous and discontinuous turbulent boundary layer at the periphery. In hydrodynamics, this action is described as hydroplaning; in aerodynamics, aeroplaning. In each case, water resistance and air resistance are reduced and dynamic stability and effective range is increased.

When the disc is thrown in a predetermined manner and direction, as described herein, with sufficient force and spin toward the surface of a body of water, it will skim and skip over the water surface. As the disc travels over the surface of a body of water, two directions of hydroplaning occur; one linear, one radial. Relative to the direction of travel (linear aspect) of the disc over a water surface, the whole disc functions as a hydroplane. Relative to the spin or rotation (rotational aspect) of the disc over a water surface, the inertia of the device provides the rotative continuity and there is some gyroscopic action which cooperates with the camming effect of the lower periphery.

It is an object of the invention to provide a relatively simply constructed device which has aerodynamic and hydrodynamic characteristics which make it ideal for the sport of stone skipping.

Other objects and features of the invention will be apparent in the following description and claims.

DRAWINGS accompany the disclosure, and the various views thereof may be briefly described as:

FIG. 1, a plan view of a circular disc.

Figure 2:
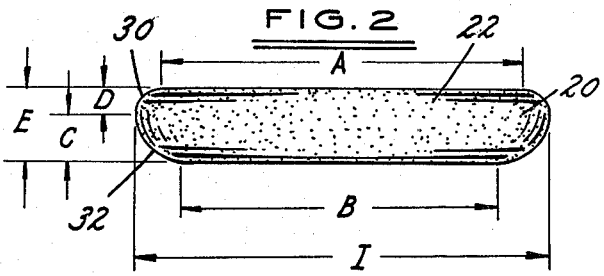

FIG. 2, a side elevation of the disc.

Figure 3:
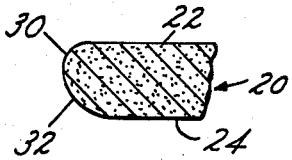

FIG. 3, a sectional view of the disc taken on line 3—3 of FIG. 1.

Figure 4:
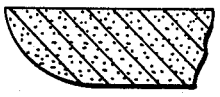

FIG. 4, a sectional view of a modified disc.

Figure 5:
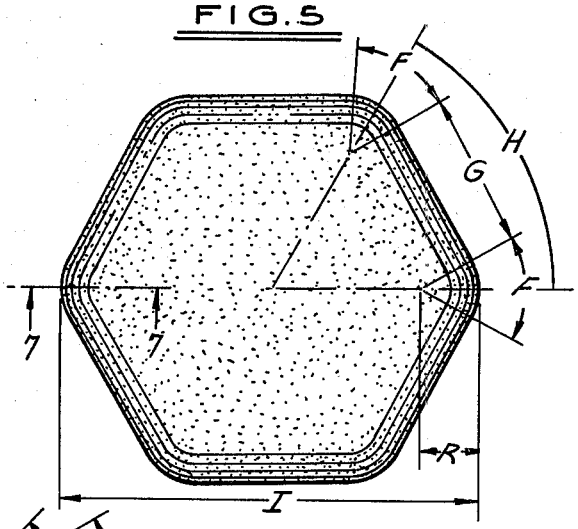

FIG. 5, a plan view of a disc approximating a 6-sided regular polygon.

Figure 6:
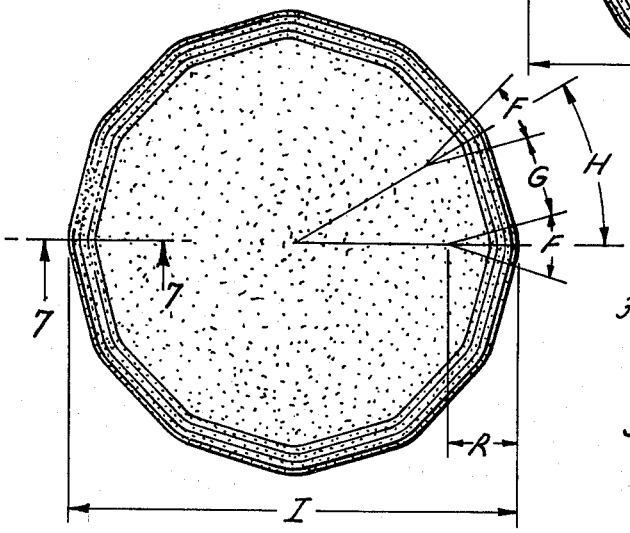

FIG. 6, a plan view of a disc approximating a 12-sided regular polygon.

Figure 7:
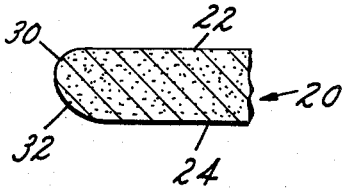

FIG. 7, a sectional view on line 7—7 of FIG. 6 which will also represent a similar sectional view on FIG. 5.

Figure 8:
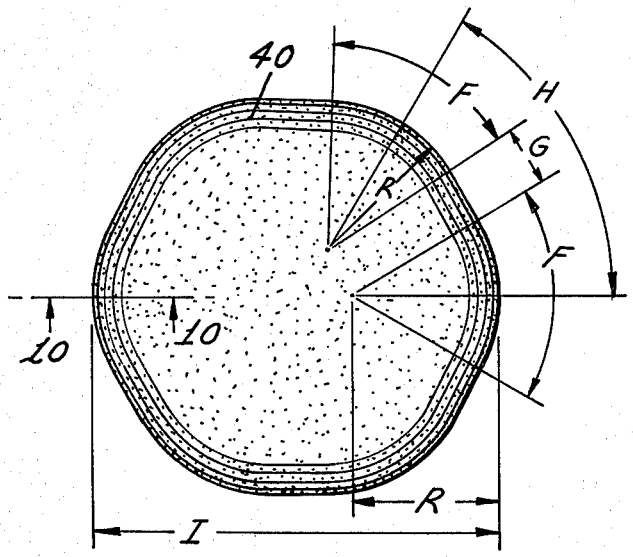

FIG. 8, a variation of FIG. 5 showing a similar but more circular plan view.

Figure 9:
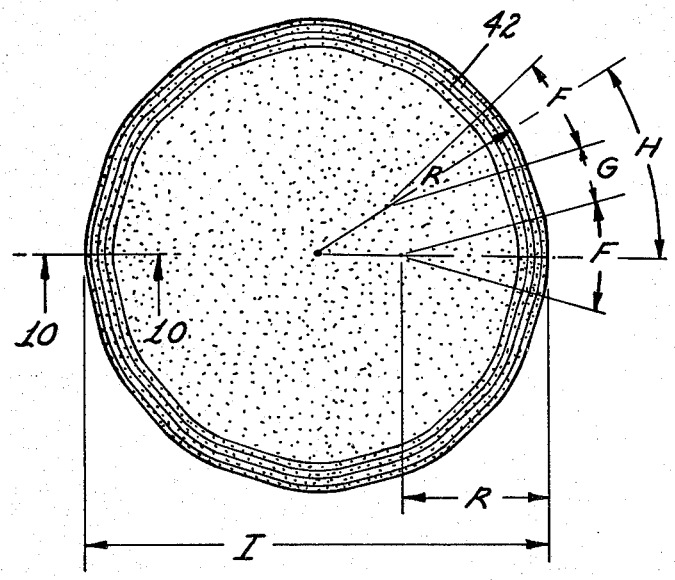

FIG. 9, a variation of FIG. 6 showing a similar but more circular plan view.

Figure 10:
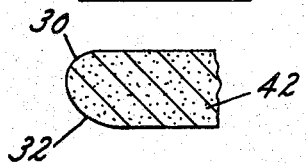

FIG. 10, a sectional view of the disc taken on line 10—10 of FIG. 8 which will also represent a similar sectional view on FIG. 9.

REFERRING TO THE DRAWINGS:

The discs shown in the figures are made from a mixture of sand and a water soluble organic binder. It is important that the disc have a texture rather than being entirely smooth and this texture can vary in terms of sandpaper measurements in which the maximum texture might be a 80 grit and the minimum texture might be 120 or finer. The discs may be made in a separable mold with top and bottom cavities, or it may be made in an open top mold which might require shaping of the edges of the discs subsequent to the casting and hardening. The edge configuration of the disc is extremely important.

As shown in the drawings, the example of FIG. 1, which is a round disc 20, has a contour which is illustrated in FIGS. 2 and 3. The portion shown with dimension A is the top flat surface 22 of the disc, and the portion shown with dimension B is the bottom flat surface 24 of the disc. The maximum diameter is shown by the line I. The edge of the disc is convex but not symmetrical in the sense that the top curve 30 between the lines delineated by the letter D is a relatively sharp curve which descends from the edge of the outer flat surface to the maximum diameter of the disc. The portion of the edge 32 delineated by the letter C extends upwardly from the outer diameter of the flat bottom B to the maximum diameter of the disc. The top dimension A always has a larger diameter than the bottom dimension B, and the thickness of the disc is shown by the dimension E.

The significance of the shape shown in FIGS. 2 and 3 lies in the fact that the curvature from the maximum outer diameter of the disc to the outer diameter of the flat base B has a relatively large radius compared to the top portion of the convex edge. Optimum performance occurs when the larger curvature C with the larger radius occupies two-thirds or more of the vertical dimension E and the curvature D with a smaller radius occupies one-third or less of the vertical dimension E. This provides a camming surface which insures that the disc, when it is projected toward a water surface, will cam upwardly and maximize the skipping characteristics of the disc.

The invention also contemplates discs approximating the form of a regular polygonal shape. In FIG. 5, a disc approximating a regular hexagonal polygon is shown formed of the same material as the disc of FIG. 1 and having the same edge contour as illustrated in FIGS. 2 and 3. FIG. 6 illustrates a disc approximating a 12-sided regular polygon, again having the same edge configuration as shown in FIG. 7.

Each peripheral hydrofoil is composed of a straight section G tangentially joined with two halves of transitional surface F having a radius R. Restated, the sequence of one-half of F tangentially joined to a straight section G which is again tangentially joined to a second one-half of F from one peripheral hydrofoil H.

Referring to FIGS. 5 and 6, when the length of the transitional radius R is equal to one-half of the maximum diameter I of the disc, then the angle of the transitional surface F is equal to the angle of the peripheral hydrofoil H and a circular disc is formed. The radius R is preferably one-third of the maximum diameter I for optimum performance.

It has been found that a circular disc having a textured surface is far superior in action to a similar type of disc that might have a very smooth surface. The degree of circularity of the disc is increased in three interdependent ways: (1) increasing the number of peripheral hydrofoils (i.e., decreasing angle H); (2) increasing R to its maximum dimension of one-half of I; (3) some combination (1) and (2) above. The increase in coarseness of the surface texture of the disc can be directly proportional to the increase in the degree of circularity of the disc. Thus, there is cooperation between the edge configuration and the texture of the material. For example, as the number of peripheral hydrofoils increases (i.e., as angle H decreases), the coarseness of the surface texture increases. Thus, the circular disc shown in FIG. 1 might have a maximum texture of 80 to 120 grit sandpaper, the 12-sided stone shown in FIG. 6 might have a texture comparable to 80 to 120 sandpaper grit size, and the 6-sided stone shown in FIG. 5 might have a texture comparable to 120 or finer sandpaper grit size.

Similarly, as R increases in length from its minimum of one-eighth of I to its maximum of one-half of I, the coarseness of the surface texture increases. Thus, when R is less than or equal to one-half of I but greater than or equal to one-third of I (i.e., high degree of circularity as shown in FIGS. 8 and 9), the surface texture might approximate 80 to 120 grit sandpaper; and when R is less than or equal to one-third of I but greater than or equal to one-eighth of I (i.e., low degree of circularity as shown in FIG. 5), the surface texture might approximate 120 or finer sandpaper grit size.

While cheaper self-cast stones may be made with a smooth surface and might be utilized for practice (See FIG. 4), the stones with the texture above recited are far more successful in operation. While it has been suggested that the stones can be might from an aggregate with a soluble binder, it might also be possible to make the stones from cast metal or plastic, for example, if they could be used in a controlled environment where they were retrievable.

In connection with the dimensions shown in FIG. 2, it is preferable that the dimension D be approximately one-third or less of the dimension E so that there is a relatively large radius of curvature (i.e., two-thirds or more of the dimension E) on the lower portion extending from the maximum outer diameter to the diameter of a flat base B. The same is true in connection with the edge formation of the structures shown in FIGS. 5, 6, 8 and 9. When the curvature with the larger radius of the lower portion is equal to the dimension E and the curvature with the smaller radius of the upper portion is equal to zero, a rim configuration is formed as shown in FIG. 4.

The discs are formed of a material which should be significantly heavier than an equal volume of water and, of course, accordingly, would be non-floating. This weight factor has been further beneficial to the overall performance of the disc because a heavier-than-water disc contains more potential energy than a lighter-than-water disc. Therefore, there is increased ability of the disc to maintain its inertia during hydroplaning.

The discs shown in FIGS. 1, 5, 6, 8 and 9 are intended to be gripped in one hand, the peripheral edge being held between the first finger and the thumb, with the thumb side of the middle finger curving under the disc and supporting the bottom surface. Alternatively, the first finger is along the periphery with the thumb on the top surface and the thumb side of the middle finger curving under and supporting the bottom surface. The throwing release should be such that the spin is about the vertical axis of the disc, this being imparted by allowing the disc to roll quickly off the first finger. The disc is thrown in a manner such that upon release, the bottom surface is parallel with, closest to, and speeding toward the surface of a body of water. Beneficial aerodynamic and hydromechanical properties are displayed as the disc aeroplanes and hydroplanes, alternately skipping over, skimming on, and filtering across the surface of a body of water.

In FIGS. 8 to 10, are showings which illustrate modified discs with a higher degree of circularity because of larger R dimensions in connection with polygonal figures. In FIG. 8, the disc 40 has a larger R dimension than the comparable 6-sided configuration in FIG. 5, thus providing a more arc-like peripheral hydrofoil H. In FIG. 9, a 12-sided disc 42 comparable to FIG. 6 has a larger R dimension and, accordingly, a more arc-like peripheral hydrofoil H.

We claim:

1. An aerodynamic and hydromechanical hydroplaning disc comprising:

(a) a disc-like solid and unitary body of heavier-than-water material having a substantially flat top surface parallel to a substantially flat bottom surface enclosing the bulk of the center portion of the disc, the top surface being significantly larger than the bottom surface, and (b) a peripheral surface joining the top and bottom surfaces such that said peripheral surface is formed with a predetermined convex contour relative to the central axis perpendicular to the flat surfaces, said contour having a relatively larger radius of curvature for the bottom of the peripheral surface and a relatively smaller radius of curvature for the top of the peripheral surface, said curvatures blending tangentially at the periphery and at the respective top and bottom surfaces.

2. A disc as defined in claim 1 in which the projection of the larger radius curvature onto a line parallel to the central vertical axis of the disc occupies approximately two-thirds or more of the total vertical dimension of the disc and the projection of the smaller radius curvature onto said line occupies about one-third or less of the total vertical dimension of the disc.

3. A disc as defined in claim 1 in which the body has a texture comparable to that of sandpaper in the range of 80 to 120 grit size.

4. A disc as defined in claim 1 in which the body approximates a regular polygon in shape having six or more slots joined by an equal number of transitional arcs forming an equal number of distinct peripheral hydrofoils.

5. A disc as defined in claim 4 having transitional arcs tangentially joining adjacent peripheral hydrofoils such that the lengths of said radii of said arcs are approximately one-third the maximum diameter of the disc.

6. A disc as defined in claim 4 in which the surface textue of the disc has a coarseness in direct proportion to the number of peripheral hydrofoils.

7. A disc as defined in claim 4 in which the surface texture of the disc has a coarseness in direct proportion to the length of the radii of transitional said arcs.

8. A disc according to claim 4 in which the degree of circularity is increased interdependently with respect to the number of hydrofoils and the increase in length of the radii of said transitional arcs.

9. A disc according to claim 4 in which the surface texture of the disc has a coarseness in direct proportion to the degree of circularity of the disc.

* * * * *